US009486912B1

(12) United States Patent
Chen

(10) Patent No.: US 9,486,912 B1
(45) Date of Patent: Nov. 8, 2016

(54) PIVOTAL STRUCTURE FOR A RECEIVING SEAT OF A TOOLBOX

(71) Applicant: Su-Chiu Chen, Tainan (TW)

(72) Inventor: Su-Chiu Chen, Tainan (TW)

( * ) Notice: Subject to any disclaimer, the term of this patent is extended or adjusted under 35 U.S.C. 154(b) by 0 days.

(21) Appl. No.: 15/089,578

(22) Filed: Apr. 3, 2016

(51) Int. Cl.
*B65D 85/28* (2006.01)
*B25H 3/02* (2006.01)

(52) U.S. Cl.
CPC ..... *B25H 3/02* (2013.01)

(58) Field of Classification Search
CPC ..... B25H 3/003; B25H 3/02
USPC ..... 206/379, 372, 373, 374, 375, 377, 378, 206/349, 564, 565; 211/69
See application file for complete search history.

(56) References Cited

U.S. PATENT DOCUMENTS 6,991,103 B2 * 1/2006 Chen ..... B25H 3/003 206/373
7,066,341 B1 * 6/2006 Hartford ..... A61L 2/26 211/169
7,780,016 B1 * 8/2010 Cornwell ..... B25H 3/003 211/69
7,931,143 B1 * 4/2011 Lin ..... B25H 3/021 206/373
9,156,156 B2 * 10/2015 Wang ..... B25H 3/021
9,156,157 B2 * 10/2015 Wang ..... B25H 3/021
2005/0241974 A1 * 11/2005 Chen ..... B25H 3/003 206/379
2006/0070902 A1 * 4/2006 Tuan-Mu ..... B25H 3/003 206/378
2007/0068836 A1 * 3/2007 Lin ..... B25H 3/003 206/375
2009/0266730 A1 * 10/2009 Lin ..... B25H 3/003 206/372

* cited by examiner

*Primary Examiner* — Jacob K Ackun
*Assistant Examiner* — Jenine Pagan

(57) ABSTRACT

A toolbox includes a toolbox body having a bottom wall and a chamber delimited by the bottom wall. Two plates are mounted to and extend perpendicularly to the bottom wall. Each plate includes at least one pivot hole in the form of a partial hole having first and second stop walls. Each of the first and second stop walls extends away from a center of the partial hole. At least one receiving seat includes a plurality of grooves and two sidewalls. An axle is formed on each sidewall and is pivotably engaged in the pivot hole of one of the plates. Each axle is semi-cylindrical and includes a rectilinear wall having a length slightly smaller than a diameter of the pivot hole. The rectilinear wall includes two half sections respectively having first and second abutment portions corresponding to a storage position and an extended position of the receiving seat.

3 Claims, 5 Drawing Sheets

PIVOTAL STRUCTURE FOR A RECEIVING SEAT OF A TOOLBOX

BACKGROUND OF THE INVENTION

The present invention relates to a pivotal structure for a receiving seat of a toolbox and, more particularly, to a pivotal structure for restricting a pivotal angle of a receiving seat of a toolbox while providing enhanced stability of pivotal movement and wider applications.

Conventional toolboxes generally include a chamber for receiving tools. Some of the toolboxes includes grooves for receiving tools, such as screwdriver bits, providing a tidy arrangement and avoiding wobbling of the tools.

The thickness of a toolbox using grooves to keep the bits in an upright position must be larger than the length of the bits. To solve this disadvantage, pivotable receiving seats are proposed for receiving screwdriver bits or other tools, such that the receiving seats can pivot between a storage position and an extended position. Applicant's U.S. Pat. No. 8,196,742 discloses a tool bit toolbox including a base and a plurality of bit seats pivotably mounted to the base. Each bit seat includes a plurality of bit grooves for receiving bits. An axle is formed on each of two sides of each bit seat. Each bit seat further includes an abutment portion. Two mounting plates are provided on a bottom wall of the base. Each mounting plate includes a plurality of pivot holes. Each pivot hole receives one of the axles of one of the bit seats. Ribs are formed on the bottom wall of the base. When each bit seat is in the storage position, the bit grooves are parallel to the extending direction of the bottom wall of the base to reduce the storage volume. In use, each bit seat is pivoted to the extended position to permit easy removal of the bits, and the abutment portion of each bit seat abuts the ribs to restrict the pivotal movement of the bit seats.

However, the axles pivotably received in the pivot holes cannot restrict the pivotal angle, and the ribs required for restricting the pivotal movement of the bit seats causes limitation to the deign of the bottom wall of the base. Furthermore, the ribs cannot reliably abut the abutment portions of the bit seats when subjected to a large force.

BRIEF SUMMARY OF THE INVENTION

An objective of the present invention is to provide a toolbox with a pivotal structure for restricting a pivotal angle of a receiving seat while providing enhanced stability of pivotal movement and wider applications.

A toolbox according to the present invention includes a toolbox body having a bottom wall and a chamber delimited by the bottom wall. Two plates are mounted to and extend perpendicularly to the bottom wall. The two plates are parallel to each other. Each of the two plates includes at least one pivot hole. The at least one pivot hole is a partial hole and includes a first stop wall and a second stop wall. Each of the first and second stop walls extends from a center of the partial hole away from the center of the partial hole. At least one receiving seat includes a plurality of grooves and two sidewalls opposite to each other. An axle is formed on each of the two sidewalls and is pivotably engaged in the at least one pivot hole of one of the two plates. The at least one receiving seat is pivotable between a storage position and an extended position. Each axle is semi-cylindrical and includes a rectilinear wall having a length slightly smaller than a diameter of the at least one pivot hole. The rectilinear wall includes two half sections respectively having first and second abutment portions corresponding to the storage position and the extended position. When the at least one receiving seat is in the storage position, the first abutment portion abuts the first stop wall. When the at least one receiving seat is in the extended position, the second abutment portion abuts the second stop wall.

The at least one pivot hole can be substantially three quarters of a circular hole. The first stop wall is at an angle of 90° to the second stop wall. An end of the first stop wall adjoins an end of the second stop wall.

At least one of the two plates can include a positioning protrusion adjacent to the at least one pivot hole. At least one of the two sidewalls of the at least one receiving seat can include first and second positioning grooves respectively corresponding to the storage position and the extended position. The positioning protrusion engages in the first positioning groove when the at least one receiving seat is in the storage position. The positioning protrusion engages in the second positioning groove when the at least one receiving seat is in the extended position.

The present invention will become clearer in light of the following detailed description of illustrative embodiments of this invention described in connection with the drawings.

DESCRIPTION OF THE DRAWINGS

FIG. 1A is an enlarged view of a circled portion of FIG. 1.

FIG. 1B is an enlarged view of another circled portion of FIG. 1.

DETAILED DESCRIPTION OF THE INVENTION

Figure 1:
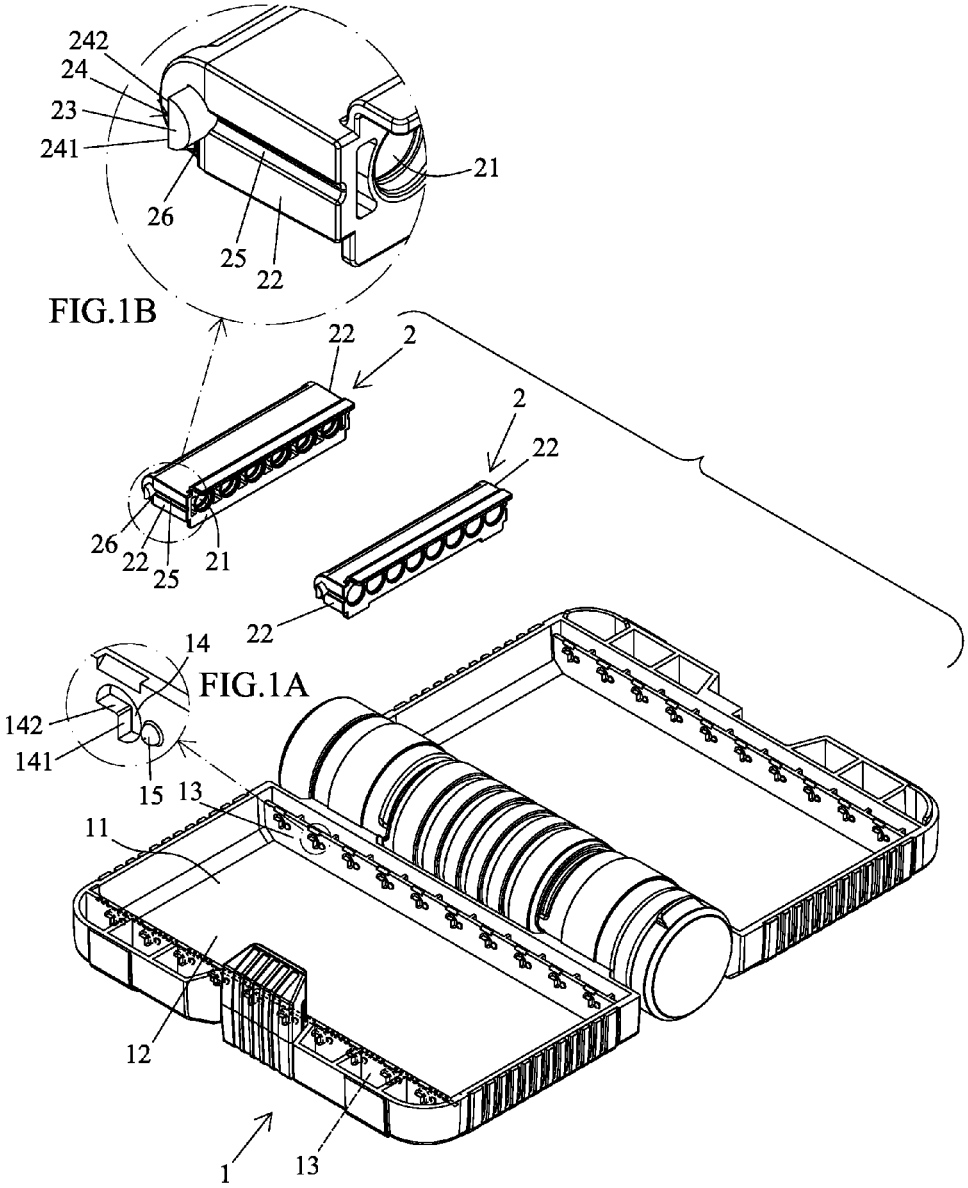
FIG. 1 shows an exploded, perspective view of a toolbox according to the present invention.

With reference to FIGS. 1-5, a toolbox of an example according to the present invention includes a toolbox body 1 and two receiving seats 2. The toolbox body 1 includes a bottom wall 12 and a chamber 11 delimited by the bottom wall 12. Two plates 3 are mounted to and extend perpendicularly to the bottom wall 12. The two plates 13 are parallel to each other. Each of the two plates 13 includes ten pivot holes 14. Each pivot hole 14 is a partial hole. In this example, each pivot hole 14 is substantially three quarters of a circular hole and includes first and second stop walls 141 and 142. Each of the first and second stop walls 141 and 142 extends from a center of the partial hole away from the center of the partial hole. The first stop wall 141 is at an angle of 90° to the second stop wall 142. The first stop wall 141 has an end adjoining an end of the second stop wall 142. Each plate 3 includes a plurality of positioning protrusions 15. Each positioning protrusion 15 is located adjacent to one of the pivot holes 14.

In this example, one of the receiving seats 2 includes six grooves 21 for receiving bits 3 or other tools, and the other receiving seat 2 includes eight grooves 21 for receiving bits 3 or other tools. Each receiving seat 2 further includes two sidewalls 22 opposite to each other. An axle 23 is formed on each sidewall 22 and is pivotably engaged in a corresponding pivot hole 14 of one of the two plates 3. Thus, each receiving seat 2 is pivotable between a storage position and an extended position. In this example, each axle 23 is semi-cylindrical and includes a rectilinear wall 24 having a length slightly smaller than a diameter of the pivot hole 14. The rectilinear wall 24 includes two half sections respectively having first and second abutment portions 241 and 242 corresponding to the storage position and the extended position. Furthermore, each sidewall 22 of each receiving seat 2 includes first and second positioning grooves 25 and 26 respectively corresponding to the storage position and the extended position.

Each receiving seat 2 can be coupled to one of the pivot holes 14 in a desired location of the corresponding plate 3. Each axle 23 of each receiving seat 2 is pivotably engaged in the corresponding pivot hole 14. Note that the bottom wall 12 of the toolbox body 1 does not have to include any protrusion for retaining the receiving seats 2 in the storage position or the extended position. Thus, other tools can placed on the bottom wall 12 of the toolbox body 1, providing wider applications.

Figure 2:
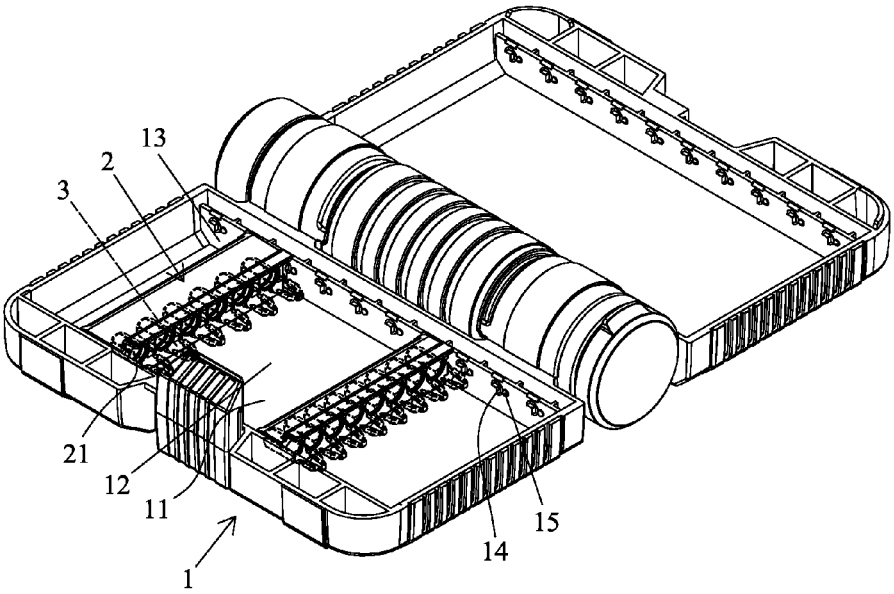
FIG. 2 is a perspective view of the toolbox in an open state, with each receiving seat in a storage position.
Figure 3:
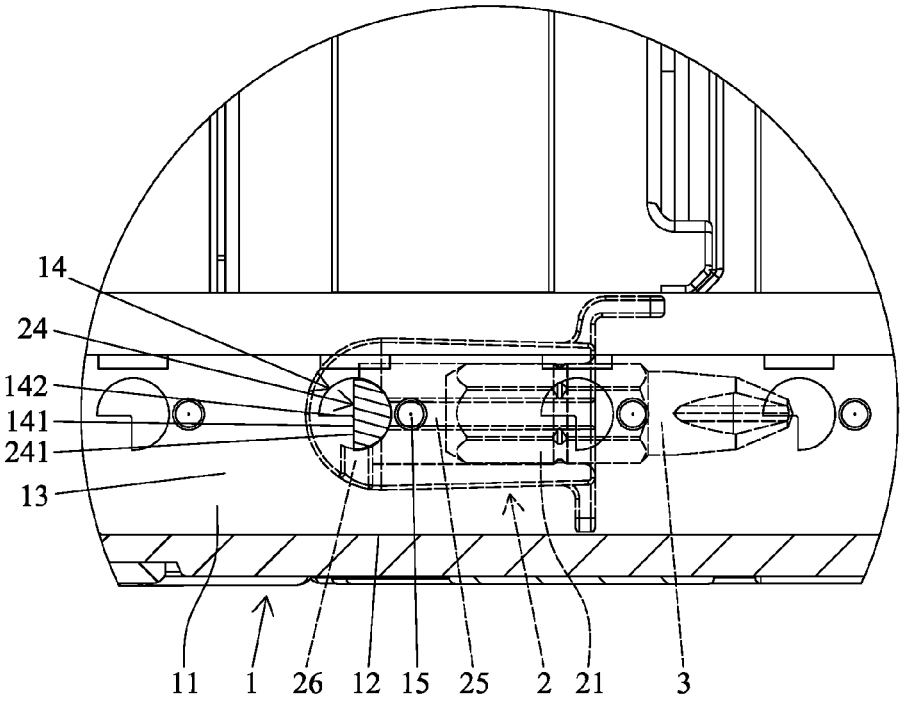
FIG. 3 is a diagrammatic view illustrating a receiving seat in the storage state.

With reference to FIGS. 2 and 3, the bits 3 can be received in the grooves 21 of the receiving seats 2. When each receiving seat 2 is in the storage position, the first abutment portion 241 abuts the first stop wall 141, and the positioning protrusion 15 engages in the first positioning groove 25. In this case, each bit 3 is parallel to the bottom wall 12 to reduce the height in the storage position.

Figure 4:
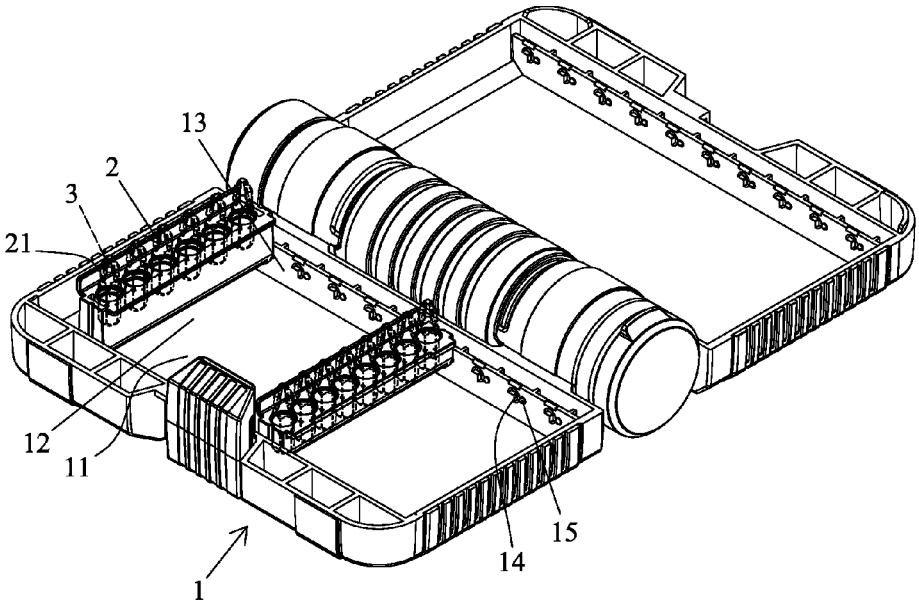
FIG. 4 is a perspective view of the toolbox, with each receiving seat in an extended position.
Figure 5:
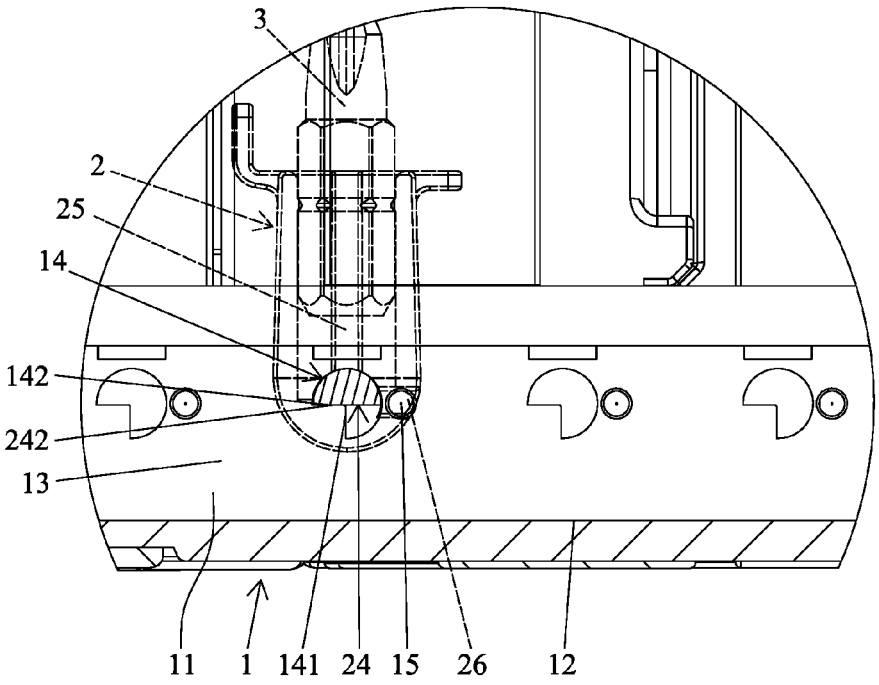
FIG. 5 is a diagrammatic view illustrating a receiving seat in the extended state.

With reference to FIGS. 4 and 5, when each receiving seat 2 is in the extended position, the second abutment portion 242 abuts the second stop wall 142, and the positioning protrusion 15 engages in the second positioning groove 26. Thus, excessive pivotal movement of the receiving seats 2 is avoided, providing enhanced stability while moving the receiving seats 2 to the extended positions.

The pivot holes 14 do not have to be third quarters of a circular hole. The angle between the first and second stop walls 241 and 242 can be other than 90°. Namely, the receiving seats 2 in the extended position do not have to be perpendicular to the bottom wall 12. Instead, the receiving seats 2 in the extended position can be in a desired inclined angle relative to the bottom wall 12. The bits 3 can easily be removed when the receiving seats 2 are in the extended position. Further, each plate 13 does not have to include the positioning protrusions 15. Each receiving seat 2 does not have to include the first and second positioning grooves 25 and 26. Furthermore, one of the plates 3 can include circular pivot holes 14 cooperating with cylindrical axles 23 while the other plate 3 uses partial holes cooperating with semi-cylindrical axles 23.

Although specific embodiments have been illustrated and described, numerous modifications and variations are still possible without departing from the scope of the invention. The scope of the invention is limited by the accompanying claims.

The invention claimed is:

1. A toolbox comprising:

a toolbox body including a bottom wall and a chamber delimited by the bottom wall, with two plates mounted to and extending perpendicularly to the bottom wall, with the two plates parallel to each other, with each of the two plates including at least one pivot hole, with the at least one pivot hole being a partial hole and including a first stop wall and a second stop wall, with each of the first and second stop walls extending from a center of the partial hole away from the center of the partial hole;

at least one receiving seat including a plurality of grooves and two sidewalls opposite to each other, with an axle formed on each of the two sidewalls and pivotably engaged in the at least one pivot hole of one of the two plates, with the at least one receiving seat pivotable between a storage position and an extended position, with each axle being semi-cylindrical and including a rectilinear wall having a length slightly smaller than a diameter of the at least one pivot hole, and with the rectilinear wall including two half sections respectively having first and second abutment portions corresponding to the storage position and the extended position, wherein when the at least one receiving seat is in the storage position, the first abutment portion abuts the first stop wall, and wherein when the at least one receiving seat is in the extended position, the second abutment portion abuts the second stop wall.

2. The toolbox as claimed in claim 1, with the at least one pivot hole being substantially three quarters of a circular hole, with the first stop wall at an angle of 90° to the second stop wall, and with the first stop wall having an end adjoining an end of the second stop wall.

3. The toolbox as claimed in claim 1, with at least one of the two plates including a positioning protrusion adjacent to the at least one pivot hole, with at least one of the two sidewalls of the at least one receiving seat including first and second positioning grooves respectively corresponding to the storage position and the extended position, wherein the positioning protrusion engages in the first positioning groove when the at least one receiving seat is in the storage position, and wherein the positioning protrusion engages in the second positioning groove when the at least one receiving seat is in the extended position.

* * * * *